United States Patent [19]

Vetter

[11] Patent Number: 5,068,885

[45] Date of Patent: Nov. 26, 1991

[54] ROTARY-ANODE X-RAY TUBE COMPRISING A HELICAL-GROOVE SLEEVE BEARING AND LUBRICANT RESERVOIR WITH CONNECTING DUCT SYSTEM

[75] Inventor: Axel Vetter, Hamburg, Fed. Rep. of Germany

[73] Assignee: U.S. Philips Corporation, New York, N.Y.

[21] Appl. No.: 459,914

[22] Filed: Jan. 2, 1990

[30] Foreign Application Priority Data

Jan. 12, 1989 [DE] Fed. Rep. of Germany ..... 3900729

[51] Int. Cl.[5] ..... H01J 35/10

[52] U.S. Cl. ..... 378/133; 378/132; 378/125; 384/371

[58] Field of Search ..... 378/132, 133, 144, 125; 384/132, 371, 368, 292

[56] References Cited

U.S. PATENT DOCUMENTS

| | | | |
|---|---|---|---|
| 3,399,000 | 8/1968 | Remmers et al. | 308/9 |
| 4,220,379 | 9/1980 | Pimiskern et al. | 384/371 |
| 4,413,356 | 11/1983 | Hartl | 378/132 |
| 4,557,610 | 12/1985 | Asada et al. | 384/107 |
| 4,573,807 | 3/1986 | Asada et al. | 384/107 |
| 4,641,332 | 2/1987 | Gerkema | 378/125 |
| 4,644,577 | 2/1987 | Gerkema et al. | 378/133 |
| 4,856,039 | 8/1989 | Roelandse et al. | 378/133 |

*Primary Examiner*—Edward P. Westin
*Assistant Examiner*—Kim-Kwok Chu
*Attorney, Agent, or Firm*—Brian J. Wieghaus

[57] ABSTRACT

The invention relates to a rotary-anode X-ray tube comprising a sleeve bearing, notably a helical-groove bearing, for journalling the rotary anode in the axial direction, which bearing comprises at least two pairs of bearing surfaces for taking up axial forces acting in opposite directions, each pair comprising two bearing surfaces which are present on bearing portions which are rotatable with respect to one another and which bearing surfaces cooperate via a lubricant, the helical-groove bearing communicating with the vacuum space of the X-ray tube via at least opening. Because at the area between the pairs of bearing surfaces there is provided a lubricant reservoir which communicates with the lubricant in the pairs of bearing surfaces and in the stationary bearing portion there is provided a duct which connects the lubricant reservoir to the vacuum space of the X-ray tube, it is achieved that the bearing will not be damaged in the case of loss of lubricant.

13 Claims, 2 Drawing Sheets

ROTARY-ANODE X-RAY TUBE COMPRISING A HELICAL-GROOVE SLEEVE BEARING AND LUBRICANT RESERVOIR WITH CONNECTING DUCT SYSTEM

BACKGROUND OF THE INVENTION

Of interest is commonly owned copending application entitled X-ray Tube, Ser. No. 07/618,350, filed Nov. 26, 1990 in the name of Rolf Golitzer and Lothar Weil.

The invention relates to a rotary-anode X-ray tube comprising a sleeve bearing, for journalling the rotary anode in the axial direction, which bearing comprises at least two pairs of bearing surfaces for taking up axial forces acting in opposite directions, each pair comprising two bearing surfaces which are present on bearing portions which are rotatable with respect to one another, and which bearing surfaces cooperate via a lubricant, the sleeve bearing communicating with the vacuum space of the X-ray tube via at least one opening.

An X-ray tube of this kind, comprising a sleeve bearing in the shape of a helical-groove bearing, is known from EP-OS 141 476. In practice it is unavoidable that droplets of lubricant escape from the bearing. Because the amount of lubricant of such bearings is limited, this loss of lubricant may lead to the descruction of the bearing.

SUMMARY OF THE INVENTION

It is the object of the present invention to construct a rotary-anode X-ray tube of the kind set forth so that in the case of loss of lubricant damaging of the bearing is substantially precluded.

This object is achieved in accordance with the invention in that a lubricant reservoir is provided at the area between the pairs of bearing surfaces, which reservoir communicates with the lubricant within the pairs of bearing surfaces, there being provided a system of ducts which connects the lubricant reservoir to the vacuum space of the X-ray tube to equalize the reservoir lubricant pressure with the vacuum. In the case of loss of lubricant, lubricant will flow from the lubricant reservoir to the pairs of bearing surfaces. Without the system of ducts this would be impossible because such a flow requires cavitation in the lubricant reservoir. Such cavitation, however, is usually prevented by the surface stress of the lubricant. Such cavitation is enabled only by the duct, thus enabling the flow from the lubricant reservoir to the loaded area of the pairs of bearing surfaces.

BRIEF DESCRIPTION OF THE DRAWINGS

The invention will be described in detail hereinafter with reference to the drawing. Therein.

DESCRIPTION OF THE PREFERRED EMBODIMENT

Figure 1:
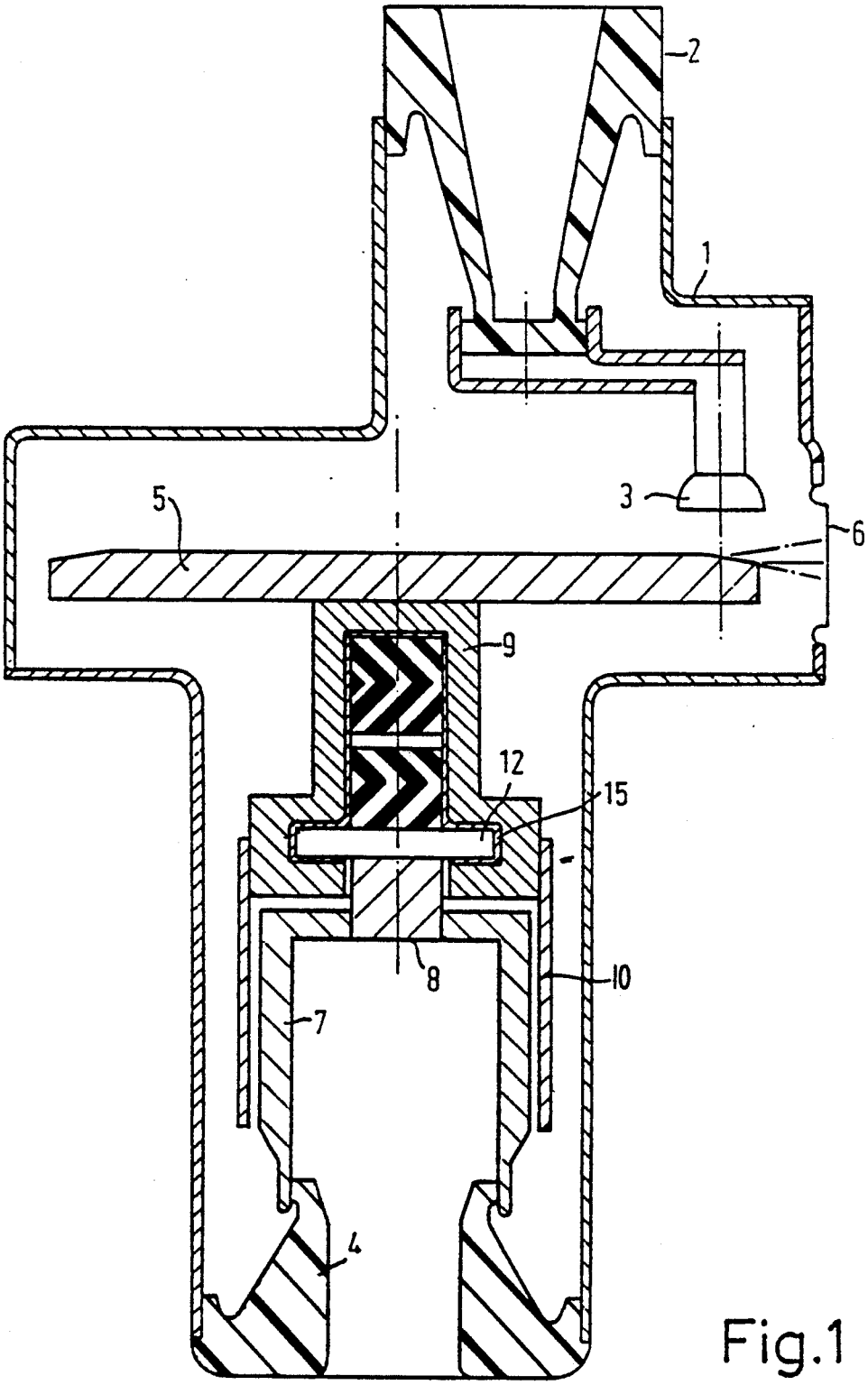
FIG. 1 shows a rotary-anode X-ray tube in accordance with the invention.
Figure 2:
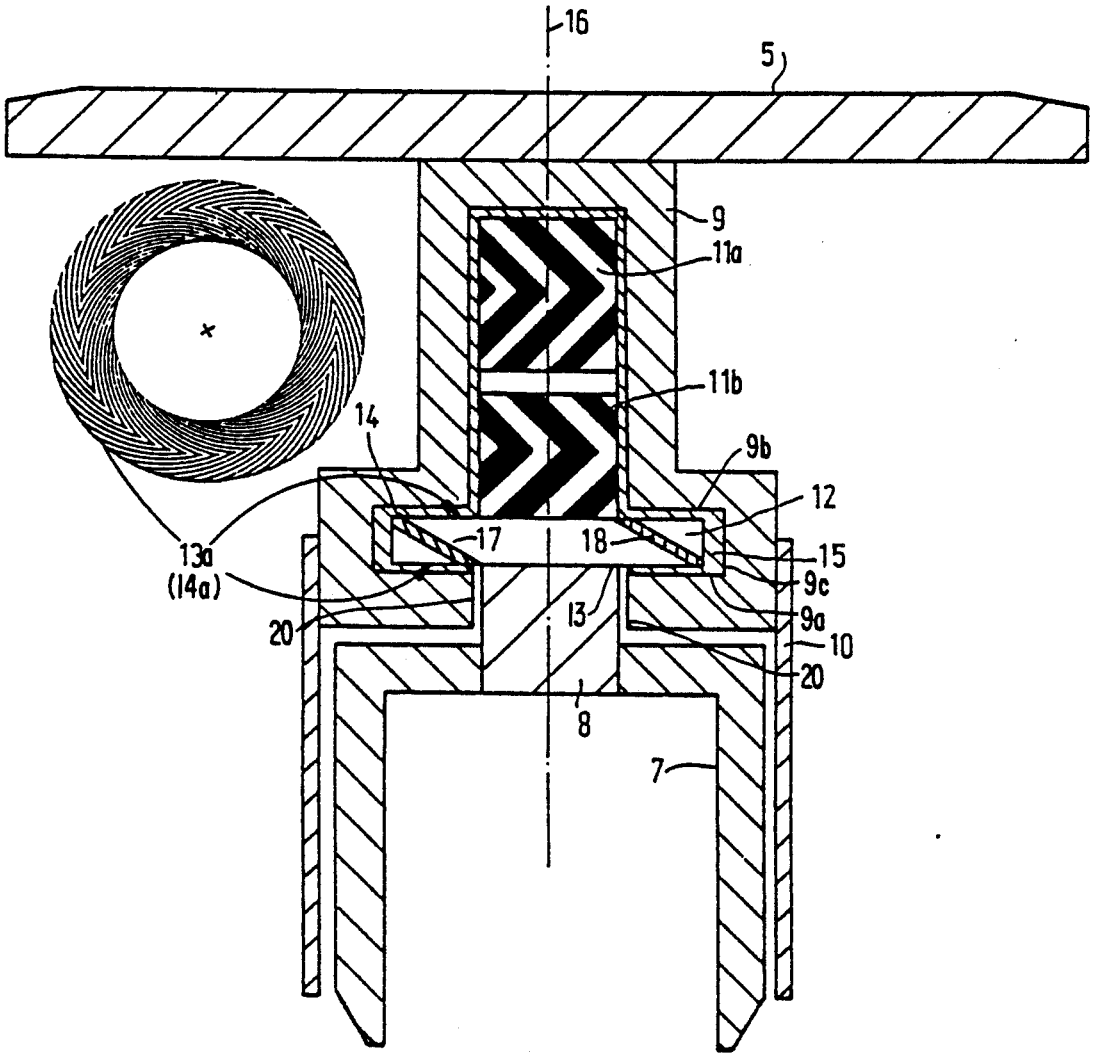
FIG. 2 shows a part of such a tube.

The rotary-anode X-ray tube shown in FIG. 1 comprises a metal envelope 1 to which the cathode 3 is secured via a first insulator 2 and to which the rotary anode is secured via a second insulator 4. The rotary anode comprises an anode disc 5 whose surface which faces the cathode 3 generates X-rays when a high voltage is applied, which X-rays emanate via a preferably beryllium radiation exit window 6 in the envelope 1. Via a bearing, the anode disc 5 is connected to a supporting member 7 which is connected to the second insulator 4. As appears notably from FIG. 2, the bearing comprises a bearing shaft 8 which is rigidly connected to the supporting member 7 and also comprises a bearing shell 9 which concentrically encloses the bearing shaft 8 and the lower end of which is provided with a rotor 10 for driving the anode disc 5 connected to the upper end of the bearing shell 9. The bearing shaft 8 and the bearing shell 9 are made of tungsten, molybdenum or a tungsten-molybdenum alloy (TZM).

At its upper end, or end closest to disc 5, the bearing shaft 8 is provided with two fishbone-like helical-groove patterns 11*a*, 11*b* which have been offset in the axial direction. The grooves have a depth of only a few μm and the ratio of the surface areas of the grooves to the intermediate surface areas is preferably 1:1. The space between the groove patterns 11*a* and 11*b* and the bearing shell 9 is filled with a liquid lubricant, preferably a gallium alloy (GaInSn). The surfaces of the shaft 8 which are provided with the groove patterns 11 and the oppositely situated surfaces of the bearing shell 9 thus form a helical-groove bearing which takes up the radial bearing forces.

Adjacent the groove pattern 11*b*, the bearing shaft 8 comprises a portion 12 of several millimeters thickness whose diameter is substantially larger than the diameter of the remainder of the bearing shaft 8; said portion is followed by a portion whose diameter is slightly smaller than the diameter of the upper portion of the bearing shaft 8 and which is connected to the supporting member 7. The interior contour of the bearing shell 9 is adapted to the exterior contour of the shaft 8; consequently, the bearing shell cannot have an integral construction as shown in the drawing, but must consist of at least two portions which are suitably connected to one another at the area of the portion 12, so that the lubricant cannot escape via the joint.

The end face 13 of the portion 12 closest to supporting member 7 is provided with a fishbone-like pattern 13*a* of grooves and forms, in conjunction with a parallel extending face 9*a* of the bearing shell 9, a pair of bearing surfaces which is capable of taking up upwards directed forces exerted on the rotary anode. The end face 14 of the portion 12 closest to the bearing 11*a*, 11*b*, is provided with a similar groove pattern 14*a*. In conjunction with the facing parallel surface 9*b* of the bearing shell 9 it constitutes a pair of bearing surfaces which takes up downwards directed axial forces exerted on the rotary anode.

The bearing shaft 8 and the bearing shell 9 is closed in the direction of the anode disc 5; the film of lubricant adjoins the vacuum space only at the lower portion face 13. In order to prevent the faces 20 adjoining the bearing surfaces 13*a* from being wetted by lubricant, thus extracting lubricant from the bearing, the upper surfaces 20 at the area of the opening of the bearing are provided with a layer which cannot be wetted by the lubricant, for example a titanium-oxide layer as known from EP-OS 141 476. However, the escape of lubricant in the case of shock-like mechanical loading of the bearing cannot be precluded. Considering that the lubricant gap is substantially smaller than shown in the drawing and typically amounts to approximately 20 μm, it will be evident that even when a small amount of lubricant escapes, a comparatively large part of the lubricant contained in the bearing will be lost, which could lead to a reduction of the supporting strength and damaging of the bearing, notably during starting and stopping of rotation of the anode.

In order to prevent such damage, a compartively large gap is formed between the outer surface of the portion 12 and the oppositely situated surface 9c of the bearing shell 9 extending concentrically with respect thereto, which gap encloses a lubricant reservoir 15. For a thickness of the portion 12 of, for example 6 mm and a diameter of this portion of 50 mm, a gap of only 0.5 μm suffices to form a lubricant reservoir of approximately 500 $mm^3$, which is large in comparison with the amounts of lubricant in the radial and the axial helical-groove bearing (70 $mm^3$ and 50 $mm^3$, respectively). Because the lubricant in the lubricant reservoir 15 is situated at the largest distance from the axis of rotation 16, the centrifugal forces produced during rotation of the rotary anode (and shell 9) ensure that the lubricant will remain in the reservoir during normal operation.

Should lubricant have escaped from the bearing (usually from the area of the lower end face 13 of the portion 12 of the bearing shaft), the lubricant still present within this pair of bearing surfaces will exert a pulling force on the lubricant present in the lubricant reservoir 15 during rotation of the anode, but the lubricant cannot simply flow from the lubricant reservoir into the evacuated space between said pair of bearing surfaces. This is because a tearing apart of the lubricant film or cavitation at the area of the lubricant reservoir would then be necessary, and this is prevented by the surface stress of the lubricant.

In order to enable replenishment of lubricant, the portion 12 of the bearing shaft 8 is provided with a duct 17 which connects the lubricant reservoir 15 to the area of the opening, so that the end of this duct which is remote from the lubricant reservoir communicates with the vacuum space in the X-ray tube. In the case of loss of lubricant, the lubricant initially present in the duct 17 is transported to the lubricant reservoir 15 and subsequently the vacuum can expand as far as inside the lubricant reservoir 15 so as to form a cavitation therein. The duct 17 comprises pressure equalization means thus ensures that all bearing areas automatically receive the necessary amount of lubricant.

The diameter of the duct should be as large as possible, be it only so large (for example, 0.6 mm) that the capillary forces still retain the lubricant and do not allow it to flow into the vacuum space of the rotary-anode X-ray tube. This may not happen either during rotation of the rotary anode. Therefore, a duct which extends radially outwards through the bearing shell 9 is prohibited, because the centrifugal forces could force the lubricant outwards through the duct during operation. This risk is absent in the case of the duct 17 which extends inwards toward the axis of rotation from the lubricant reservoir. In order to enable fast replenishment from the lubricant reservoir in the case of loss of lubricant, it may be effective to provide a plurality of ducts 17 which are then uniformly distributed along the circumference, symmetrically with respect to the axis of rotation.

When the anode disc is displaced downwards under the influence of a load variation, the lubricant gap of the helical-groove bearing at the anode side is reduced. As a result, the pressure built up at that area increases, causing a pumping effect so that lubricant is drawn at the outer and the inner edge of this bearing. The lubricant then emenates from the oppositely situated helical-groove bearing 13. This transport of lubricant through the narrow bearing gap would produce high underpressures, which might cause tearing of the lubricant film (cavitation). Such cavitation or strong lubricant flows across the bearing surfaces can be avoided by means of a duct 18 which has approximately the same diameter as the duct 17 and which connects the inner side of the helical-groove bearing 14 which is remote from the opening of the bearing to the lubricant reservoir 15. This is because the lubricant is then fed from the reservoir 15 to the inner edge of the bearing 14 via the duct 18. The duct 17 has a similar effect for the opposite axial movement when it terminates at the area of the inner edge of the axial helical-groove bearing 13.

In the present embodiment the bearing shaft 8 of the bearing is stationary and the bearing shell 9 rotates and the portion of the bearing opening to the vacuum is remote from the anode disc. However, the shaft B could alternatively rotate and the shell 9 could be stationary; the bearing opening would then face the anode disc. The ducts 17 and 18 could then also be provided within the inner portion and should then extend inwards from the lubricant reservoir.

For the present embodiment a bearing is assumed whose portion provided with helical grooves has a cross-section in the form of a T turned upside down. However, this portion could alternatively have a rectangular cross-section, i.e. the helical grooves could be provided on the end faces and envelopes of a cylindrical bearing sleeve. The lubricant reservoir is then situated on the envelope between the two helical-groove bearings provided at that area. In order to establish a connection to the axial helical-groove bearings on the end faces (it is substantially impossible to transport the lubricant to that area via the radial bearings), there must be provided a system of ducts which connects the edges of the bearing shaft to the lubricant reservoir. Moreover, the lubricant reservoir must be connected to the vacuum space via a plurality of ducts (i.e. again via a system of ducts); the entrance opening must then be situated nearer to the axis of rotation than the reservoir. The two systems of ducts may have part of their ducts in common.

It has been assumed thus far that the axial and the radial journalling is realized by way of separate bearings. However, the invention can also be used for helical-groove bearings which are formed (as known per se from EP-OS 141 476) so that the pairs of bearing surfaces can take up not only axially directed forces but also radially directed forces.

I claim:

1. A rotary anode x-ray tube having an x-ray tube housing in which a vacuum is maintained, a rotary anode rotatable within said housing about an axis of rotation, and a sleeve bearing for rotatably supporting said anode during anode rotation, said sleeve bearing comprising a sleeve and a shaft rotatable with respect to each other about said axis of rotation, said sleeve and said shaft comprising two axially spaced axial bearings each for axially supporting said anode in a respective different axial direction, each bearing comprising a pair of bearing surfaces rotatable with respect to each other about said axis of rotation and a lubricant between said bearing surfaces, and an opening between said shaft and said sleeve through which said lubricant communicates with the vacuum within said housing, the improvement comprising:

a lubricant reservoir located axially between said axial bearings, said reservoir containing lubricant and communicating with said lubricant between said bearing surfaces for replenishing lubricant lost from between said bearing surfaces, and pressure equalization means for connecting said reservoir to the vacuum of said housing and equalizing the reservoir lubricant pressure with said vacuum.

2. A rotary anode x-ray tube according to claim 1, wherein an opening is present adjacent said bearing surfaces by which said lubricant between said bearing surfaces communicates with said vacuum, and said pressure equalization means comprises a duct extending from adjacent said opening to said reservoir and communicating said reservoir with said vacuum via said opening.

3. A rotary anode x-ray tube according to claim 2, wherein said reservoir comprises reservoir portions uniformly circumferentially disposed around said bearing surfaces, and said connecting means comprises a plurality of ducts distributed uniformly about and symmetrically with said axis of rotation and communicating said reservoir portions with said vacuum.

4. A rotary-anode X-ray tube as claimed in claim 2, characterized in that said lubricant reservoir is situated at a greater distance from the axis of rotation than the pair of bearing surfaces and is formed by sleeve and shaft portions which are symmetrical with respect to the axis of rotation and for which the distance between said shaft and sleeve portions is greater than the distance between said bearing surfaces.

5. A rotary-anode X-ray tube as claimed in claim 3, characterized in that said lubricant reservoir is situated at a greater distance from the axis of rotation than the pair of bearing surfaces and is formed by sleeve and shaft portions which are symmetrical with respect to the axis of rotation and for which the distance between said shaft and sleeve portions is greater than the distance between said bearing surfaces.

6. A rotary-anode X-ray tube as claimed in claim 5, characterized in that one of said bearings is further from said opening than the other bearing and an additional duct connects the pair of bearing surfaces which is remote from the opening to the lubricant reservoir at its area which is remote from said opening.

7. A rotary-anode X-ray tube as claimed in claim 4, characterized in that one of said bearings is further from said opening than the other bearing and an additional duct connects the pair of bearing surfaces which is remote from the opining to the lubricant reservoir at its area which is remote from said opening.

8. A rotary-anode X-ray tube as claimed in claim 2, characterized in that one of said bearings is further from said opening than the other bearing and an additional duct connects the pair of bearing surfaces which is remote from the opining to the lubricant reservoir at its area which is remote from said opening.

9. A rotary anode x-ray tube having an x-ray tube housing in which a vacuum is maintained, a rotary anode within said housing and rotatable about an axis of rotation, and axial bearing means for axially supporting said anode in an axial direction during anode rotation, said axial bearing means comprising two bearing surfaces rotatable with respect to each other about said axis of rotation, and a lubricant between said bearing surfaces communicating with the vacuum within said housing, the improvement comprising:

a lubricant reservoir containing lubricant and communicating with said lubricant between said bearing surfaces for replenishing lubricant lost from between said bearing surfaces, and pressure equalization means for connecting said reservoir to the vacuum of said housing and equalizing the reservoir lubricant pressure with said vacuum.

10. A rotary anode x-ray tube according to claim 9, wherein an opening is present adjacent said bearing surfaces by which said lubricant between said bearing surfaces communicates with said vacuum, and said pressure equalization means comprises a duct extending from adjacent said opening to said reservoir and communicating said reservoir with said vacuum via said opening.

11. A rotary anode x-ray tube according to claim 10, wherein said reservoir comprises reservoir portions uniformly circumferentially disposed around said bearing surfaces, and said connecting means comprises a plurality of said ducts distributed uniformly about and symmetrically with said axis of rotation and communicating said reservoir portions with said vacuum.

12. A rotary anode x-ray tube according to claim 11, wherein said axial bearing means comprises a second axial bearing having a second pair of bearing surfaces with lubricant therebetween for axially supporting said anode in a second axial direction, said reservoir being axially located between said axial bearings and communicating said second axial bearing to said first axial bearing such that lubricant lost from said first bearing via said opening causes a loss of lubricant from said second bearing, and further comprising a duct connecting said reservoir to said second bearing at a location remote from said reservoir for replenishing lubricant lost from said second bearing.

13. A rotary anode x-ray tube according to claim 9, wherein said axial bearing means comprises a second axial bearing having a second pair of bearing surfaces with lubricant therebetween for axially supporting said anode in a second axial direction, said reservoir being axially located between said axial bearings and communicating said second axial bearing to said first axial bearing such that lubricant lost from said first bearing via said opening causes a loss of lubricant from said second bearing, and further comprising a duct connecting said reservoir to said second bearing at a location remote from said reservoir for replenishing lubricant lost from said second bearing.

* * * * *